US007332050B2

(12) United States Patent
Kim

(10) Patent No.: US 7,332,050 B2
(45) Date of Patent: Feb. 19, 2008

(54) ELECTRONIC SPINNING APPARATUS, AND A PROCESS OF PREPARING NONWOVEN FABRIC USING THE SAME

(75) Inventor: Hag-Yong Kim, 167-141, Dukjin-dong, Dukjin-gu, Chonju, 561-756 Chonrabuk-do (KR)

(73) Assignees: Hag-Yong Kim, Jeonju-si (KR); Jong Cheol Park, Seoul (KR)

( * ) Notice: Subject to any disclaimer, the term of this patent is extended or adjusted under 35 U.S.C. 154(b) by 0 days.

(21) Appl. No.: 11/263,991

(22) Filed: Nov. 2, 2005

(65) Prior Publication Data

US 2006/0048355 A1 Mar. 9, 2006

Related U.S. Application Data

(62) Division of application No. 10/363,413, filed as application No. PCT/KR01/02158 on Dec. 13, 2001, now Pat. No. 6,991,702.

(30) Foreign Application Priority Data

Jul. 4, 2001 (KR) ..... 2001-39789
Jul. 12, 2001 (KR) ..... 2001-41854

(51) Int. Cl.
*D01D 5/00* (2006.01)
*D01D 5/06* (2006.01)

(52) U.S. Cl. ..... 156/273.1; 156/167; 156/178; 264/10; 264/465

(58) Field of Classification Search ..... 156/167, 156/178, 273.1, 379.6; 264/10, 465; 425/174, 425/8 E See application file for complete search history.

(56) References Cited

U.S. PATENT DOCUMENTS

| | | | |
|---|---|---|---|
| 4,044,404 | A | 8/1977 | Martin et al. |
| 4,965,110 | A | 10/1990 | Berry |
| 5,024,789 | A | 6/1991 | Berry |
| 6,106,913 | A | 8/2000 | Balonis et al. |
| 6,110,590 | A | 8/2000 | Reneker et al. |
| 6,616,435 | B2 | 9/2003 | Lee et al. |
| 6,713,011 | B2 | 3/2004 | Chu et al. |

*Primary Examiner*—Jeff H. Aftergut
*Assistant Examiner*—Michael A Tolin
(74) *Attorney, Agent, or Firm*—Birch, Stewart, Kolasch & Birch, LLP

(57) ABSTRACT

An electrospinning apparatus including a spinning dope main tank, a metering pump, a nozzle block, a collector positioned at the lower end of the nozzle block for collecting spun fibers, a voltage generator, a plurality of units for transmitting a voltage generated by the voltage generator to the nozzle block and the collector, said electrospinning apparatus containing:

a spinning dope drop device positioned between the metering pump and the nozzle block, the spinning dope drop device having (i) a sealed cylindrical shape, (ii) a spinning dope inducing tube and a gas inlet tube for receiving gas through its lower end and having its gas inlet part connected to a filter aligned, side-by-side, at the upper portion of the spinning dope drop device, (iii) a spinning dope discharge tube extending from the lower portion of the spinning dope drop device, and (iv) a hollow unit for receiving the spinning dope from the spinning dope inducing tube provided at the middle portion of the spinning dope-drop device.

11 Claims, 12 Drawing Sheets

ELECTRONIC SPINNING APPARATUS, AND A PROCESS OF PREPARING NONWOVEN FABRIC USING THE SAME

This application is a Divisional of application Ser. No. 10/363,413 filed on Mar. 4, 2003, now U.S. Pat. No. 6,991,702, and for which priority is claimed under 35 U.S.C. § 120. Application Ser. No. 10/363,413 is the national phase of PCT International Application No. PCT/KR01/02158 filed on Dec. 13, 2001 under 35 U.S.C. § 371. The entire contents of each of the above-identified applications are hereby incorporated by reference.

BACKGROUND OF THE INVENTION

1. Field of the Invention

The present invention relates to an electronic spinning (electrospinning) apparatus for mass-producing nano fibers, and a process for preparing a nonwoven fabric using the same.

2. Description of the Related Art

A conventional electrospinning apparatus and a process for preparing a non-woven fabric using the same have been disclosed under U.S. Pat. No. 4,044,404. As shown in FIG. 1, the conventional electrospinning apparatus of the patent '404 includes: a spinning dope main tank 1 for storing a spinning dope; a metering pump 2 for quantitatively supplying the spinning dope; a plurality of nozzles for discharging the spinning dope; a collector 6 positioned at the lower end of the nozzles, for collecting the spun fibers; a voltage generator 11 for generating a voltage; and a plurality of instruments for transmitting the voltage to the nozzles and the collector 6.

The conventional process for preparing the non-woven fabric using the electronic spinning apparatus will now be described in detail. The spinning dope of the spinning dope main tank 1 is consecutively quantitatively provided to the plurality of nozzles supplied with a high voltage through the metering pump 2.

Continuously, the spinning dope supplied to the nozzles is spun and collected on the collector 6 supplied with the high voltage through the nozzles, thereby forming a single fiber web.

Continuously, the single fiber web is embossed or needle-punched to prepare the non-woven fabric.

However, the conventional electrospinning apparatus and process for preparing the non-woven fabric using the same have a disadvantage in that an effect of electric force is reduced because the spinning dope is consecutively supplied to the nozzles having the high voltage.

In more detail, the electric force transmitted to the nozzles is dispersed to the whole spinning dope, and thus fails to overcome interface or surface tension of the spinning dopes. As a result, fiber formation effects by the electric force are deteriorated, which hardly achieves mass production of the fiber.

Moreover, the spinning dope is spun through the plurality of nozzles, not through nozzle blocks. It is thus difficult to control the width and thickness of the non-woven fabric.

SUMMARY OF THE INVENTION

It is therefore an object of the present invention to provide an electronic spinning apparatus which can mass-produce nano fibers by enhancing fiber formation effects by maximizing an electric force supplied to a nozzle block in electronic spinning, namely maintaining the electric force higher than the Interface or surface tension of a spinning dope.

It is another object of the present invention to provide a process for easily controlling the width and thickness of a non-woven fabric by using an electrospinning apparatus having a nozzle block in which a plurality of pins are connected.

It is yet another object of the present invention to provide a process for preparing a non-woven fabric irregularly coated with nano fibers by using the electrospinning apparatus.

BRIEF DESCRIPTION OF THE DRAWINGS

The above objects, features and advantages of the present invention will become more apparent from the following preferred embodiments when taken in conjunction with the accompanying drawings, in which.

DETAILED DESCRIPTION OF THE INVENTION

In order to achieve the above described objects, there is provided an electrospinning apparatus containing a spinning dope drop device 3 positioned between the metering pump 2 and the nozzle block 6, the spinning dope drop device having (i) a sealed cylindrical shape, (ii) a spinning dope inducing tube 3*c* and a gas inlet tube 3*b* for receiving gas through its lower end and having its gas inlet portion connected to a filter 3*a* aligned side-by-side at the upper portion of the spinning dope drop device, (iii) a spinning dope discharge tube 3*d* extending from the lower portion of the spinning dope drop device, and (iv) a hollow unit for dropping the spinning dope from the spinning dope inducing tube 3*c* formed at the middle portion of the spinning dope drop device.

In addition, a method for preparing a non-woven fabric drops flowing of a spinning dope at least once by passing the spinning dope through a spinning dope drop device before supplying the spinning dope to a nozzle block supplied with a voltage in electronic spinning.

An electronic spinning apparatus, and a process for preparing a nonwoven fabric using the same in accordance with preferred embodiments of the present invention will now be described in detail with reference to the accompanying drawings.

Figure 1:
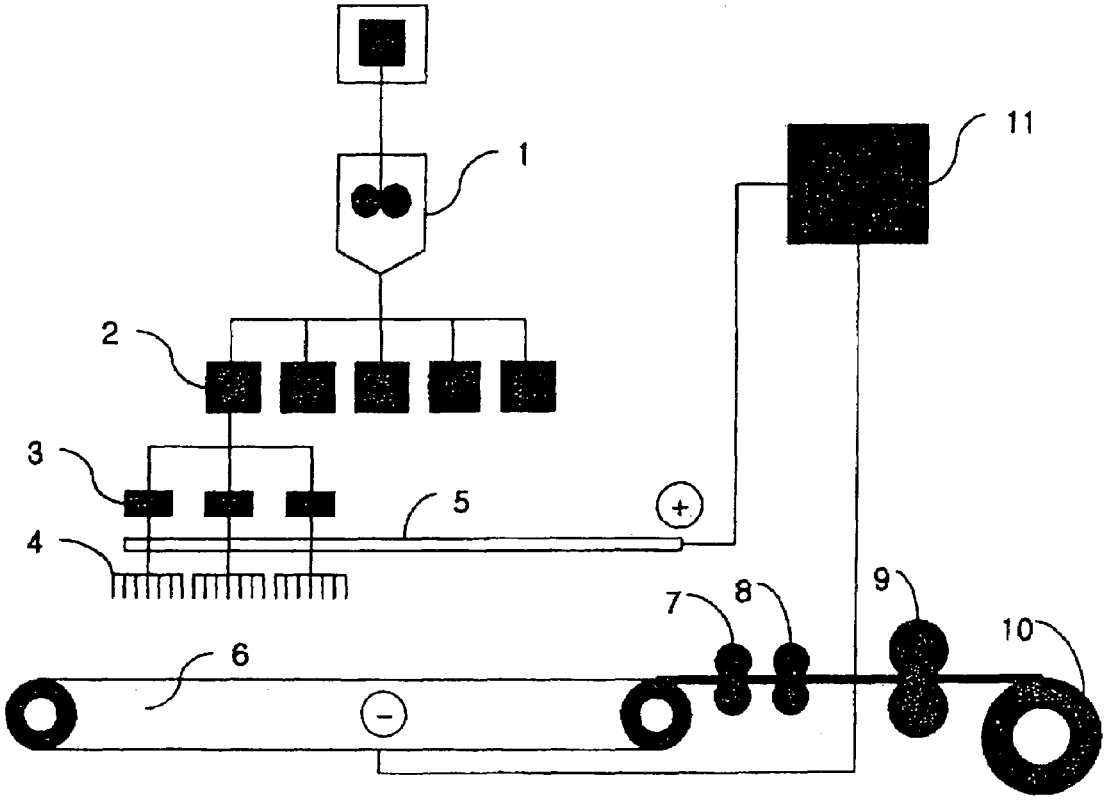
FIG. 1 is a schematic view illustrating an electrospinning apparatus in accordance with the present invention.

Referring again to FIG. 1, the electrospinning apparatus includes a spinning dope main tank 1 for storing a spinning dope; a metering pump 2 for quantitatively supplying the spinning dope; a nozzle block 4 having block-type nozzles composed of a plurality of pins, and discharging the spinning dope in a fiber shape; a collector 6 positioned at the lower end of the nozzle block 4, for collecting spun single fibers; a voltage generator 11 for generating a high voltage; a voltage transmission rod 5 for transmitting the voltage generated in the voltage generator 11 to the upper end of the nozzle block 4; and a spinning dope drop device 3 positioned between the metering pump 2 and the nozzle block 4.

As illustrated in FIGS. 4*a* to 4*d*, the spinning dope drop device 3 has a sealed cylindrical shape. A spinning dope inducing tube 3*c* for inducing the spinning dope to the nozzle block and a gas inlet tube 3*b* are aligned side-by-side at the upper end of the spinning dope drop device 3. Here, the spinning dope inducing tube 3*c* is formed slightly longer than the gas inlet tube 3*b*.

The gas is introduced from the lower end of the gas inlet tube 3*b*, and an initial gas inlet portion of the gas inlet tube 3*b* is connected to a filter 3*a* shown in FIG. 4*d*. A spinning dope discharge tube 3*d* for inducing the dropped spinning dope to the nozzle block 4 is formed at the lower end of the spinning dope drop device 3. The center portion of the spinning dope drop device 3 is hollow so that the spinning dope can be dropped from the end of the spinning dope inducing tube 3*c*.

The spinning dope inputted to the spinning dope drop device 3 flows through the spinning dope inducing tube 3*c*, but dropped at the end thereof. Therefore, flowing of the spinning dope is intercepted at least one time.

The principle of dropping the spinning dope will now be explained in detail. When the gas inlets into the upper end of the spinning dope drop device 53 through the filter 3*d* and the gas inlet tube 3*b*, a pressure of the spinning dope inducing tube 3*c* becomes irregular due to gas eddies. Such a pressure difference drops the spinning dope.

An inert gas such as air or nitrogen can be used as the gas.

On the other hand, the nozzles are aligned in block units having at least two pins. One nozzle block 4 includes 2 to 100,000 pins, preferably 20 to 2,000 pins. The nozzle pins have circular or different shape sections. In addition, the nozzle pins can be formed in an injection needle shape. The nozzle pins are aligned in a circumference, grid or line, preferably in a line.

The process for preparing the non-woven fabric using the electro-spinning apparatus in accordance with the present invention will now be described.

Firstly, a thermoplastic or thermosetting resin spinning dope stored in the main tank 1 is measured by the metering pump 2, and quantitatively supplied to the spinning dope drop device 3. Exemplary thermoplastic or thermosetting resins used to prepare the spinning dope include polyester resins, acryl resins, phenol resins, epoxy resins, nylon resins, poly(glycolide/L-lactide) copolymers, poly(L-lactide)resins, polyvinyl alcohol resins and polyvinyl chloride resins. A resin molten solution or resin solution may be used as the spinning dope.

When the spinning dope supplied to the spinning dope drop device 3 passes through the spinning dope drop device 3, flowing of the spinning dope is dropped at least once in the mechanism described above. Thereafter, the spinning dope is supplied to the nozzle block 4 having a high voltage.

The nozzle block 4 discharges the spinning dope in a single fiber shape through the nozzles. The spinning dope is collected by the collector 6 supplied with the high voltage to prepare a non-woven fabric web.

Here, to facilitate fiber formation by the electric force, a voltage over 1 kV, more preferably 20 kV is generated in the voltage generator 11 and transmitted to the voltage transmission rod 5 and the collector 6 installed at the upper end of the nozzle block 4. It is advantageous in productivity to use an endless belt as the collector 6.

The non-woven fabric web formed on the collector 6 is consecutively processed by an embossing roller 9, and the prepared non-woven fabric is wound on a winding roller 10. Thus, the preparation of the non-woven fabric is finished.

Figure 2:
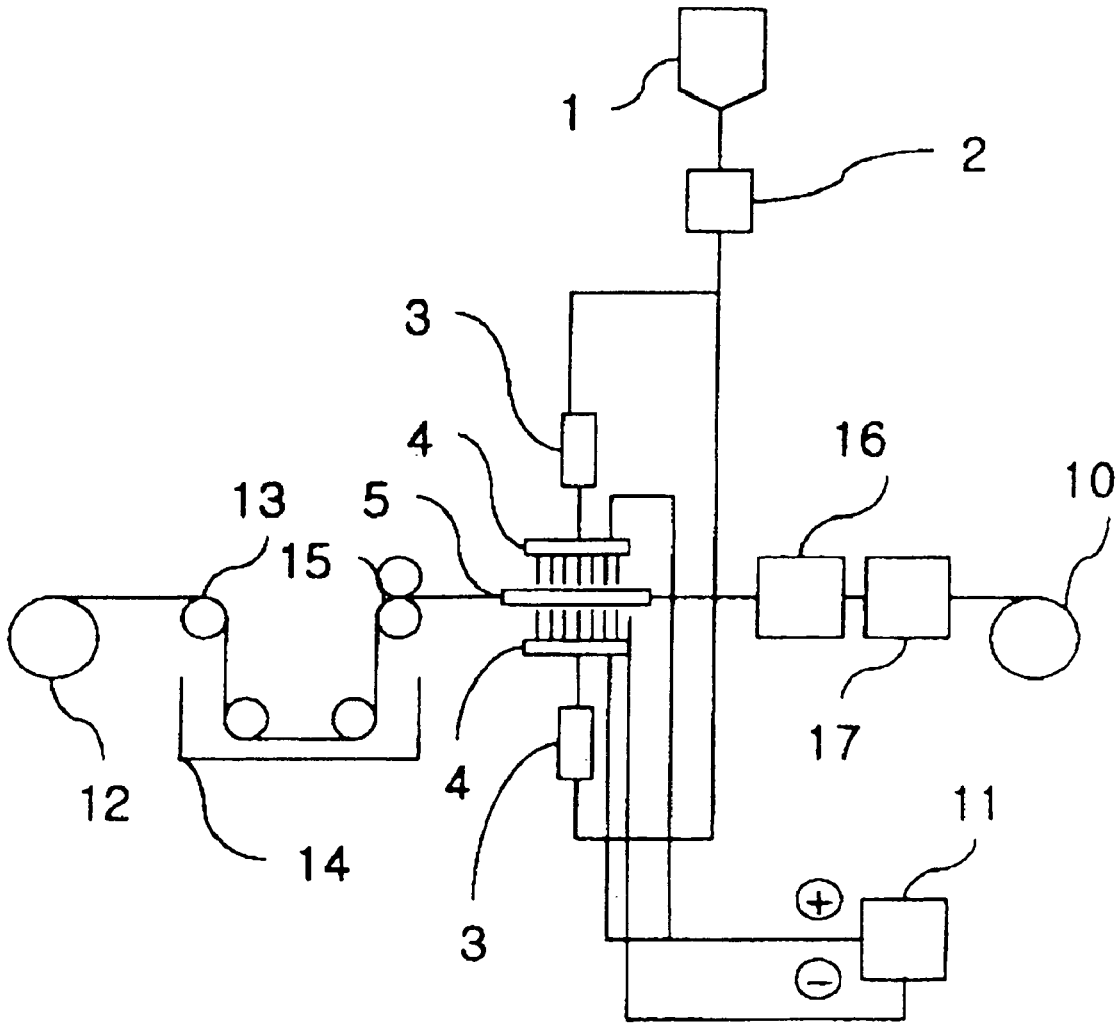
FIG. 2 is a schematic view illustrating a process of consecutively coating first component nano fibers in accordance with the present invention.
Figure 3:
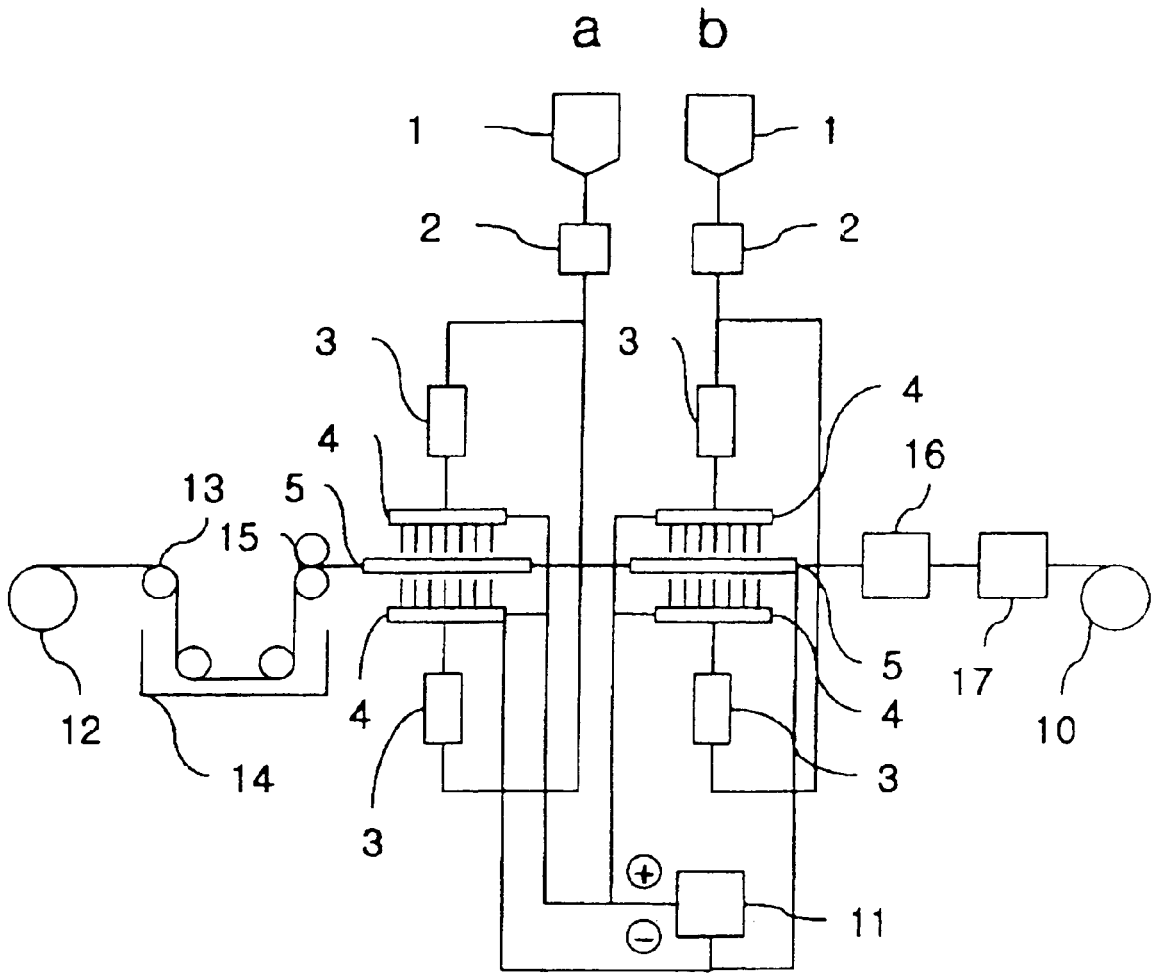
FIG. 3 is a schematic view illustrating a process of consecutively coating second component nano fibers in accordance with the present invention.
Figure 4:
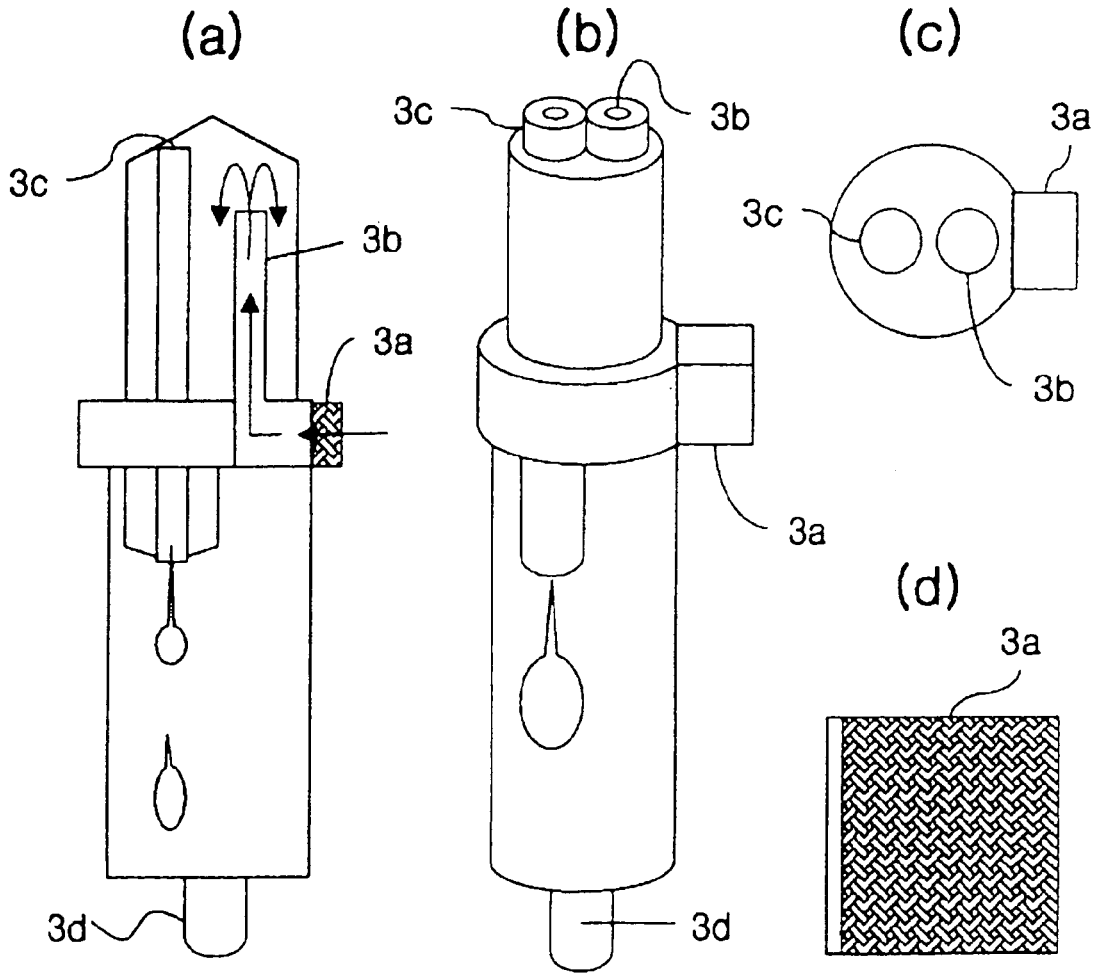
FIG. 4*a* is a cross-sectional view illustrating a spinning dope drop device 3.
FIG. 4*b* is a perspective view illustrating the spinning dope drop device 3.
FIG. 4*c* is a plan view illustrating the spinning dope drop device 3.
FIG. 4*d* is an enlarged view illustrating a filter of the spinning dope drop device 3.
Figure 5:
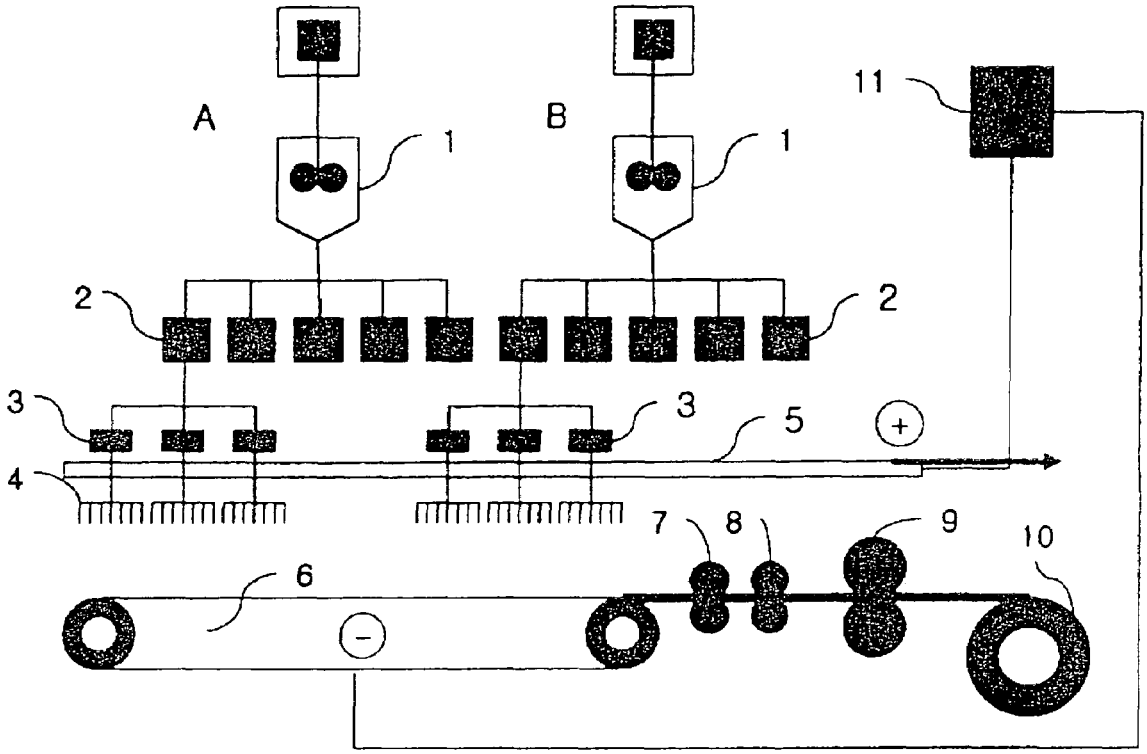
FIG. 5 is a schematic view illustrating a process of assembling two electronic spinning apparatuses in accordance with the present invention.

In another aspect of the present invention, as shown in FIG. 2 and FIG. 3, nano fibers are electrospun on one surface or both surfaces of a fiber material by using the electrospinning apparatus, and bonded. Exemplary fiber materials include fiber products such as spun yarns, filaments, textiles, knitted fabrics and non-woven fabrics, paper, films and braids.

Before spinning the nano fibers on the fiber material, the fiber material can be dipped in an adhesive solution and compressed by a compression roller 15. When the fiber material is dipped in the adhesive solution and compressed, the fiber material is preferably dried by a drier 16 before being bonded by a bonding device 17.

The fiber material on which the nano fibers are spun and adhered can be bonded according to needle punching, compression by a heating embossing roller, high pressure water injection, electromagnetic wave, ultrasonic wave or plasma.

As depicted in FIG. 3, when at least two electrospinning apparatus are employed, the spinning dopes supplied to the respective electrospinning apparatus include different kinds of polymers. Here, the nano fibers can be coated in a hybrid type.

Still referring to FIGS. 2 and 3, the electrospinning apparatus includes: a spinning dope main tank 1 for storing a spinning dope; a metering pump 2 for quantitatively supplying the spinning dope; a nozzle block 4 having block-type nozzles composed of a plurality of pins, and discharging the spinning dope onto fibers; a voltage transmission rod 5 positioned at the lower end of the nozzle block 4; a voltage generator 11 for generating a high voltage; and a spinning dope drop device 3 positioned between the metering pump 2 and the nozzle block 4.

The spinning dope drop device 3 was mentioned above.

The electrospinning process to make the nano fibers by using the electrospinning apparatus of the present invention will now be explained in more detail.

Firstly, a thermoplastic or thermosetting resin spinning dope stored in the main tank 1 is measured by the metering pump 2, and quantitatively supplied to the spinning dope drop device 3. Exemplary thermoplastic or thermosetting resins used to prepare the spinning dope include polyester resins, acryl resins, phenol resins, epoxy resins, nylon resins, poly(glycolide/L-lactide) copolymers, poly(L-lactide)resins, polyvinyl alcohol resins and polyvinyl chloride resins. A resin molten solution or resin solution may be used as the spinning dope.

Supplied to the spinning dope drop device 3, the spinning dope passes through it, and the flowing of the spinning dope is dropped at least once in the mechanism described above. Thereafter, the spinning dope is supplied to the nozzle block 4 having a high voltage.

Then the nozzle block 4 discharges the spinning dope to the fiber material in a single fiber shape through the nozzles.

Here, to facilitate fiber formation by the electric force, a voltage of over 1 kV, more preferably 20 kV is generated in the voltage generator II and transmitted to the upper end of the nozzle block 4 and the voltage transmission rod 5.

In accordance with the present invention, when the spinning dope is supplied to the nozzle block 4, flowing of the spinning dope is dropped at least once by using the spinning dope drop device 3, thereby maximizing fiber formation. As a result, fiber formation effects by the electric force are improved to mass-produce the nano and non-woven fabrics. Moreover, since the nozzles having the plurality of pins are aligned in block units, the width and thickness of the non-woven fabric can be easily controlled.

When at least two electrospinning apparatus are aligned, polymers having a variety of components can be combined with one another, which makes it easier to prepare a hybrid non-woven fabric.

In accordance with the present invention, the diameter of the fiber spun by melting spinning is over 1,000 nm, and the diameter of the fiber spun by solution spinning ranges from 1 to 500 nm. The solution spinning includes wet spinning and dry spinning.

The non-woven fabric composed of the nano fibers is used as medical materials, such as artificial organs, hygienic bands, filters, synthetic blood vessels, and as industrial materials, e.g., in semiconductor wipers and batteries, For example, a mask coated with the nano fibers is useful as an antibacteria mask, and a spun yarn or filament coated with the nano fibers is useful as a yarn for artificial suede and leather. In addition, coating nylon 6 nano fibers on a paper filter extends the life span of the filter. The fiber material coated with the nano fibers is soft to the touch.

DETAILED DESCRIPTION OF THE PREFERRED EMBODIMENT

Hereinafter, the present invention will be described in more detail through examples, but it is not limited thereto.

EXAMPLE 1

Figure 6:
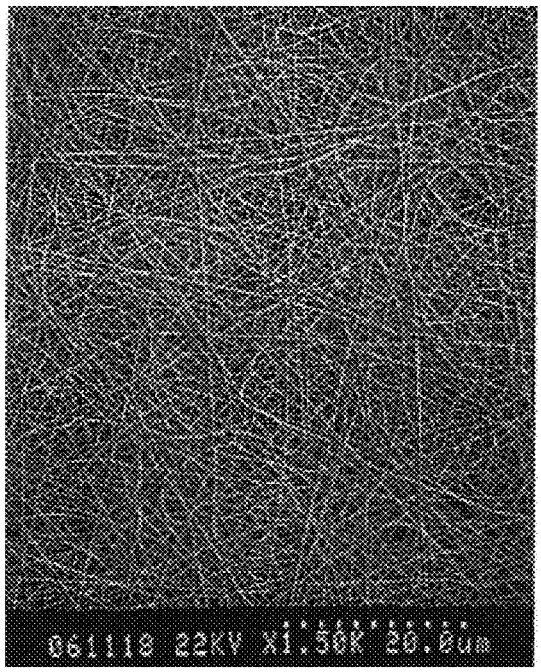
FIG. 6 is SEM (scanning electron microscope) shown a non-woven fabric prepared by using nylon 6 spinning dope dissolved in formic acid in accordance with the process of the present invention.
Figure 7:
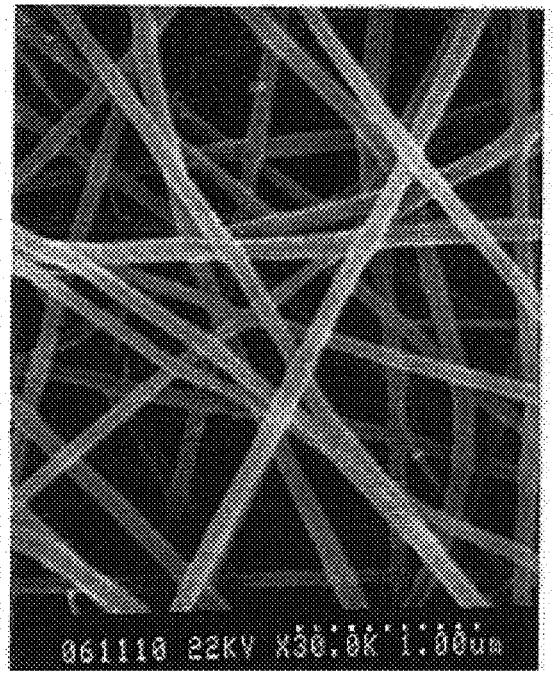
FIG. 7 is SEM to magnify FIG. 4.

Nylon 6 chip having relative viscosity of 2.3 was dissolved in formic acid by 20% in 96% of sulfuric acid solution, to prepare a spinning dope. The spinning dope was stored in the main tank 1, quantitatively measured by the metering pump 2, and supplied to the spinning dope drop device 3 of FIG. 2, thereby discontinuously changing flowing of the spinning dope. Thereafter, the spinning dope was supplied to the nozzle block 4 having a voltage of 50 kV, and spun in a fiber shape through the noz2:les. The spun fibers were collected on the collector 6, to prepare a non-woven fabric web having a width of 60 cm and weight of 3.0 g/m2. Here, each nozzle block included 200 pins, and 200 nozzle blocks were aligned. Model CH 50 of Symco Corporation was used as the voltage generator. The output rate per one pin was 0.0027 glmin (discharge amount of one nozzle block: 0.54 g/min), and thus a throughput was 108 g/min. One nozzle block was divided into 10, and one spinning dope drop device 3 was installed in every 20 pins. A drop speed had 3-second intervals. The nonwoven fabric web was transferred and embossed at a speed of 60 m/min, to prepare a non-woven fabric. Table I shows tensile strength and tensile elongation at break. FIG. 6 and FIG. 7 are illustrated SEM of the prepared nylon 6 non-woven fabric.

EXAMPLE 2

Figure 8:
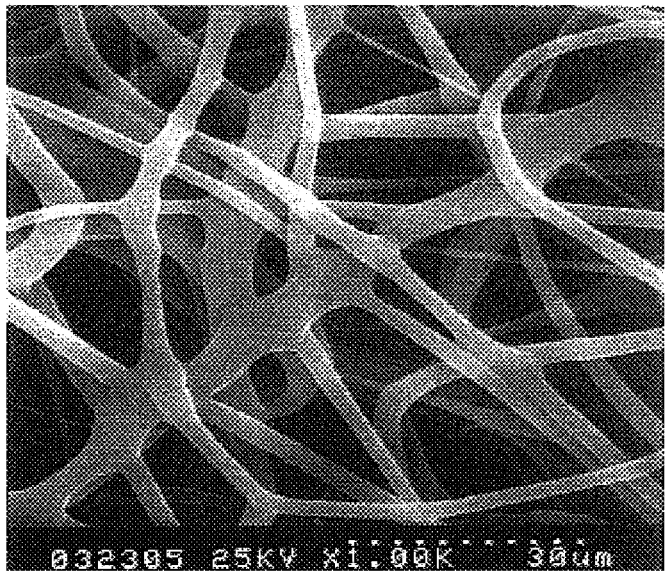
FIG. 8 is SEM shown a non-woven fabric prepared with poly(L-lactide) spinning dope dissolved in methylene chloride in accordance with the process of the present invention.

Poly(L-lactide)having a viscosii: y average molecular weight of 450,000 was dissolved in methylene chloride, to prepare a spinning dope. The spinning dope was stored in the main tank 1, cluantitatively measured by the metering pump 2, and supplied to the spinning dope drop device 3 of FIG. 2, thereby discontinuously changing flowing of the spinning dope. Thereafter, the spinning dope was supplied to the nozzle block ~1 having a voltage of 50 kV, and spun in a fiber shape through the nozzles. The spun fibers were collected on the collector 6, to prepare a non-woven fabric web having a width of 60 cm and weight of 6.9 g/m2. Here, each nozzle block included 400 pins, and 20 nozzle blocks were aligned. Model CH 50 of Symco Corporation was used as the voltage generator. The output rate per one pin was 0.0026 g/min, and thus a throughput was 20.8 g/min. One nozzle block was divided into 10, and one spinning dope drop device 3 was installed in every 40 pins. A drop speed had 3.2-second intervals. The non-woven fabric web was transferred and embossed at a speed of 5 m/min, to prepare a non-woven fabric. Table 1 shows tensile strength and tensile elongation at break. SEM of the prepared poly(L-lactide)non-woven fabric was shown in FIG. 8.

EXAMPLE 3

Figure 9:
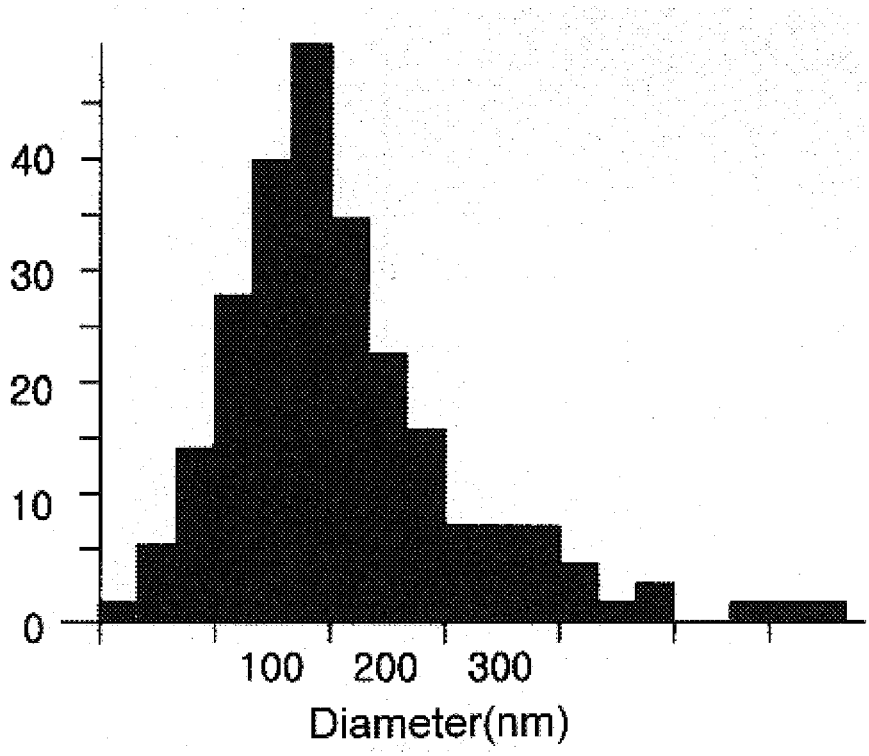
FIG. 9 is a diameter distribution of nano fibers elctrospun poly(glycolide-lactide) copolymer spinning dope by using electrospinning in accordance with the process of the present invention.

Poly(glycolide-lactide)copolymer (mole ratio:50/50)having a viscosity average molecular weight of 450,000 was dissolved in methylene chloride, to prepare a spinning dope. The spinning dope was stored in the main tank 1, quantitatively measured by the metering pump 2, and supplied to the spinning dope drop device 3 of FIG. 2, thereby discontinuously changing flowing of the spinning dope. Thereafter, the spinning dope was supplied to the nozzle block 4 having a voltage of 50 kV, and spun in a fiber shape through the nozzles. The spun fibers were collected on the collector 6, to prepare a non-woven fabric web having a width of 60 cm and weight of 8.539/m*. Here, each nozzle block included 400 pins, and 20 nozzle blocks were aligned. Model CH50 of Symco Corporation was used as the voltage generator. The throughput per one pin was 0.0032 glmin (output rate per one nozzle block:1.28 g/min), and thus a total output rate was 256 g/min. One nozzle block was divided into 10, and one spinning dope drop device 3 was installed in every 40 pins. A drop speed had 2 second intervals. The non-woven fabric web was transferred and embossed at a speed of Sm/min, to prepare a non-woven fabric. Table 1 shows tensile strength and tensile elongation at break. FIG. 9 shows the fiber diameter distribution of the prepared non-woven fabric.

EXAMPLE 4

Figure 10:
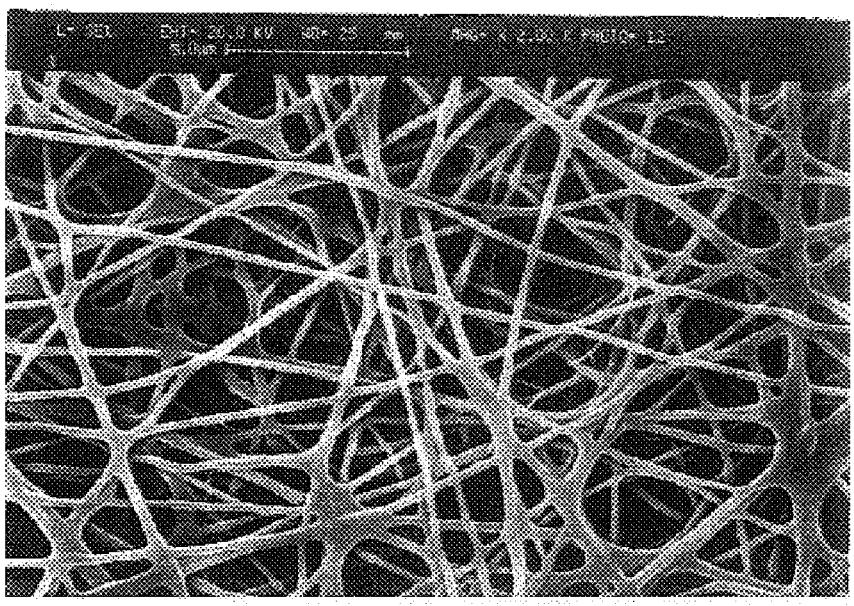
FIG. 10 is SEM shown a non-woven fabric prepared with polyvinyl alcohol spinning dope dissolved in distilled water in accordance with the process of the present invention.

Polyvinyl alcohol having a number average molecular weight of 20,000 was dissolved in distilled water, to prepare a spinning dope. The spinning dope was stored in the main tank 1, quantitatively measured by the metering pump 2, and supplied to the spinning dope drop device 3 of FIG. 2, thereby discontinuously changing flowing of the spinning dope. Thereafter, the spinning dope was supplied to the nozzle block 4 having a voltage of 50 kV, and spun in a fiber shape through the nozzles. The spun fibers were collected on the collector 6, to prepare a non-woven fabric web having a width of 60 cm and weight of 1.5 3.879/m*. Here, each nozzle block included 400 pins, and 20 nozzle blocks were aligned. Model CH 50 of Symco Corporation was used as the voltage generator. The output per one pin was 3,0029 g/min (output rate per one block: 1.28 g/min), and thus a total throughput was 23.2 g/min One nozzle block was divided into 10, and one spinning dope drop device 3 was installed in every 40 pins. A drop speed had 2.5-second intervals. The non-woven fabric web was transferred and embossed at a speed of 10 m/min, to prepare a non-woven fabric. Table 1 shows tensile strength and tensile elongation at break. FIG. 10 shows SEM of the prepared poly(vinyl alcohol)non-woven fabric.

TABLE I

| | Tensile properties | |
|---|---|---|
| Classification | Tensile Strength (kg/cm) | Tensile Elongation at break (%) |
| Example 1 | 180 | 25 |
| Example 2 | 180 | 25 |
| Example 3 | 100 | 28 |
| Example 4 | 120 | 32 |

*The tensile strength and tensile elongation were measured by ASTM D 1117

EXAMPLE 5

Figure 11:
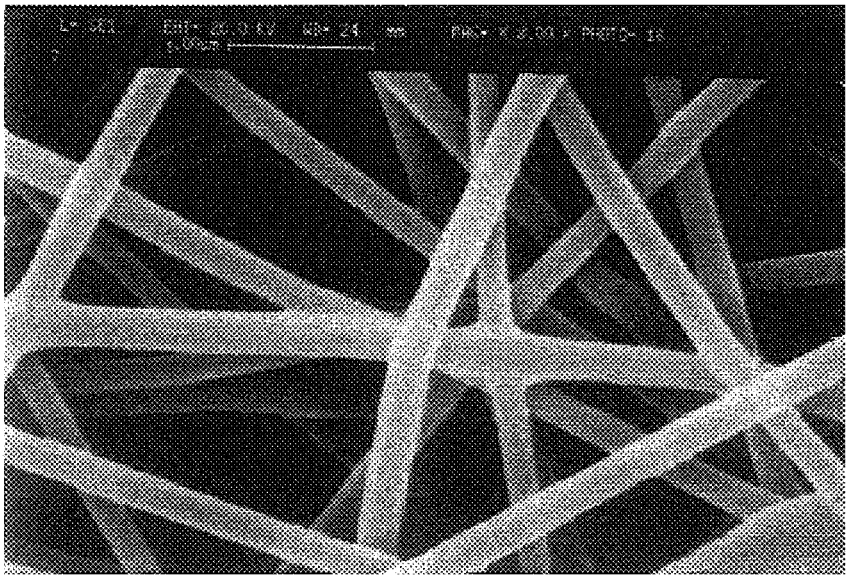
FIG. 11 is SEM to magnify FIG. 10.
Figure 12:
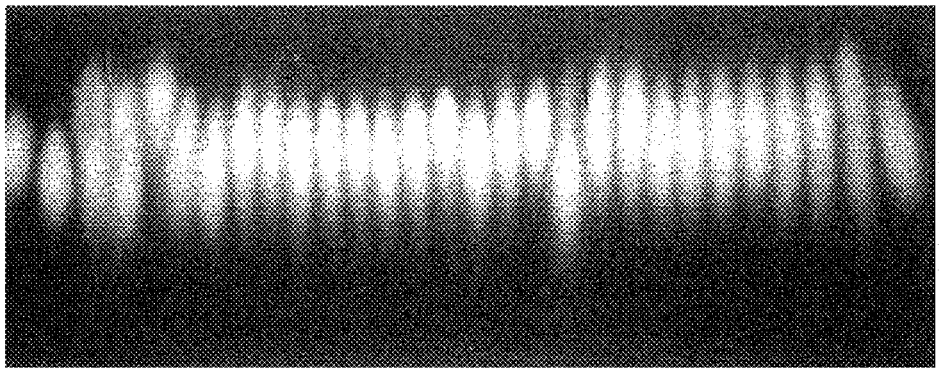
FIG. 12 is SEM shown a non-woven fabric electrospun with a nozzle width of 90 cm.
Figure 13:
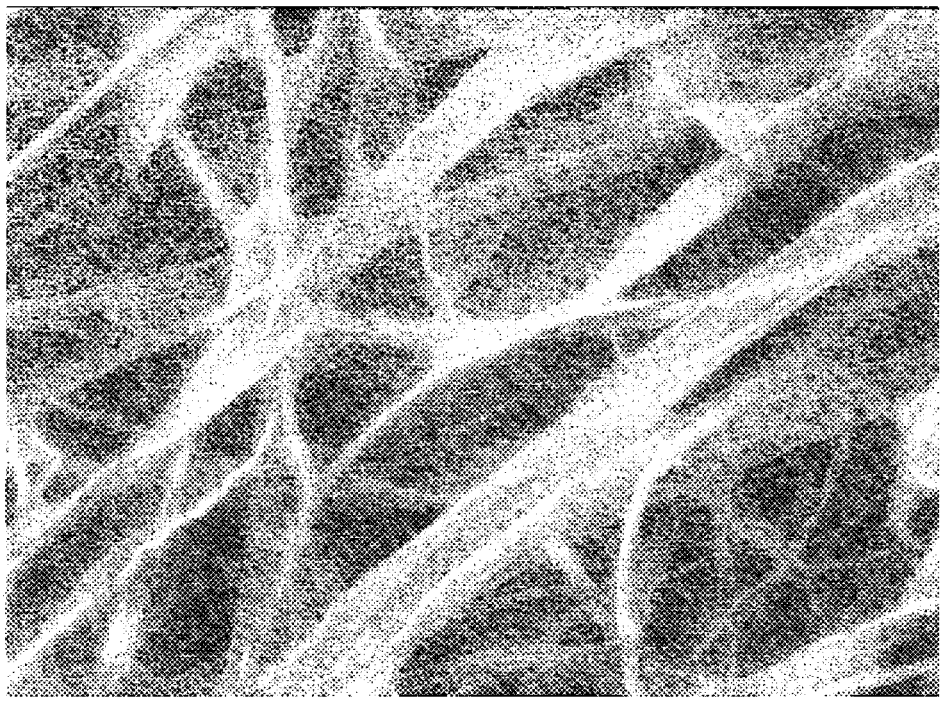
FIG. 13 is SEM shown a paper filter (product of Example 5) coated with polyvinyl alcohol nano fibers.
Figure 14:
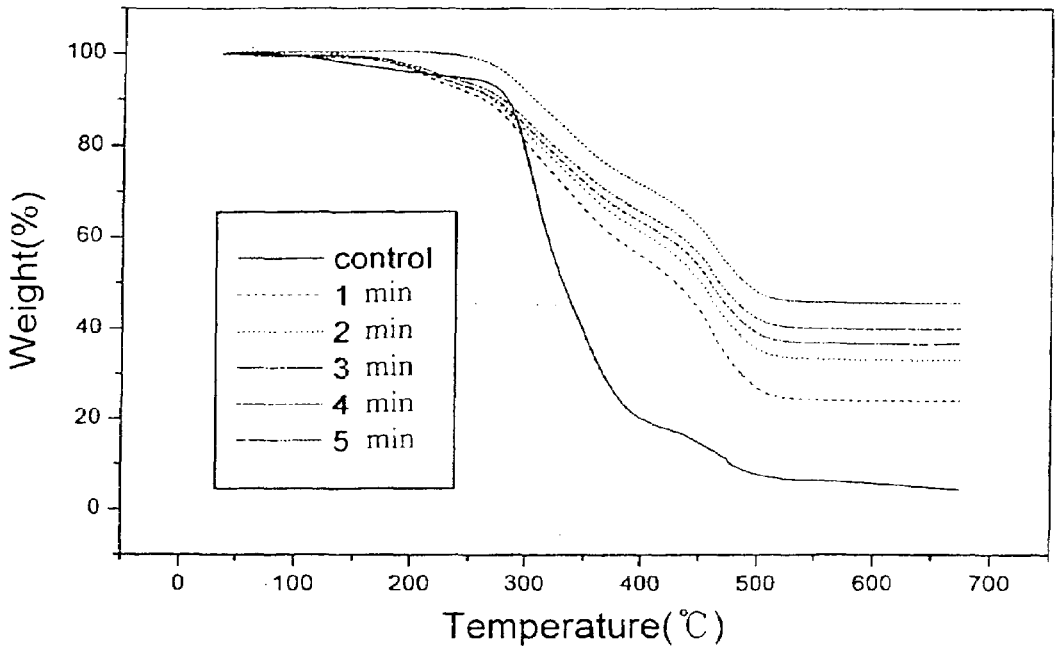
FIG. 14 is thermogravimetric analysis curves shown polyvinyl alcohol nano fibers themselves as a function of curing time.
Figure 15:
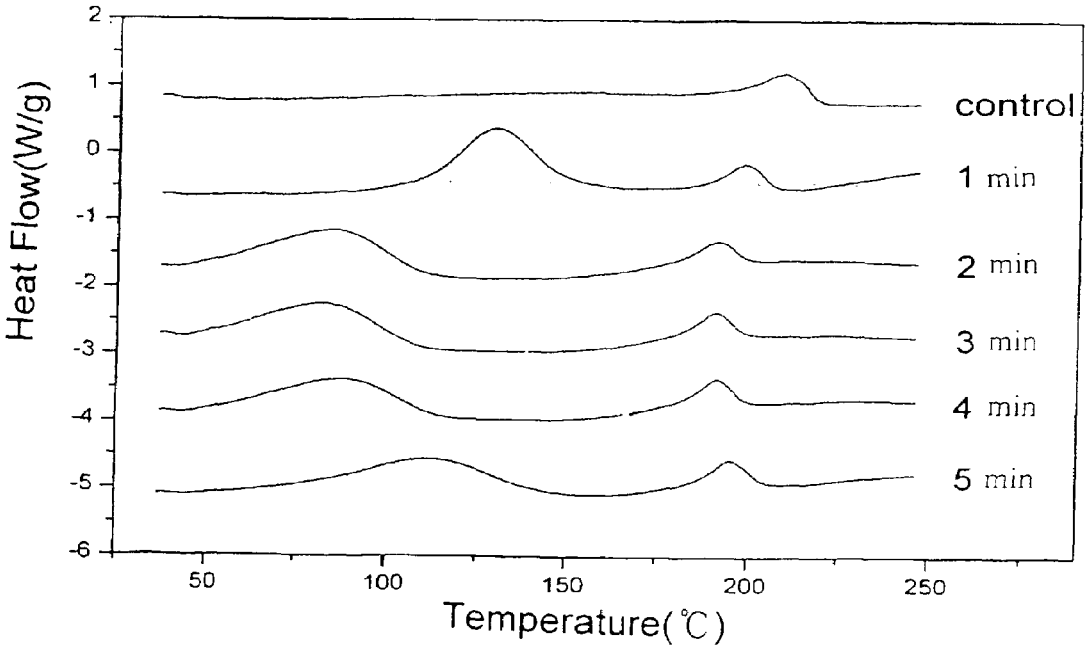
FIG. 15 is differential scanning calorimeter (DSC) curves shown polyvinyl alcohol nano fibers themselves as a function of curing time.

100 wt % of polyvinyl alcohol having a number average molecular weight of 20,000, 2 wt % of glyoxal and 1.8 wt % of phosphoric acid were dissolved in distilled water, to prepare 15% of spinning dope. The spinning dope was stored in the main tank 1, quantitatively measured by the metering pump 2, and supplied to the spinning dope drop device 3 of FIG. 4, thereby discontinuously changing flowing of the spinning dope. Thereafter, the spinning dope was supplied to the nozzle block 4 having a voltage of 45 kV, and fibers having an average diameter of 105 nm were continuously spun on the paper filter (width: 1 cm) transferred at a speed of 20 m/min through the nozzles. The fibers were compressed (bonded) by the embossing roller, to prepare a coating web having a weight of 0.61 g/m2. Here, each nozzle block included 250 pins, and 20 nozzle blocks were aligned. Model name CH 50 of Symco Corporation was used as the voltage generator. The output per one pin was 0.0027 glmin and thus a total throughput was 13.5 glmin. One nozzle block was divided into 10, and one spinning dope drop device 3 was installed in every 10 pins. A drop speed had 2.5 -second intervals. The pins were formed in a circular shape. FIG. 10 was shown the polyvinyl alcohol nano fibers themselves. SEM of FIG. 10 magnified was shown in FIG. 11. FIG. 12 was the photographs to show the evidence the mass-production by using multi-pins and poly(vinyl alcohol). SEM of paper pulp coated with polyvinyl alcohol was illustrated in FIG. 13. FIG. 14 was shown the thermogravimetric analysis of poly(vinyl alcohol) nano fibers themselves with changing the curing time. Also, differential scanning calorimeter curves of nano fibers themselves as a function of the curing time were shown in FIG. 15. When the coating paper pulp was processed in the drier of 160° C. for 3 minutes and precipitated in toluene in a normal temperature for a day, it was not dissolved.

EXAMPLE 6

Figure 16:
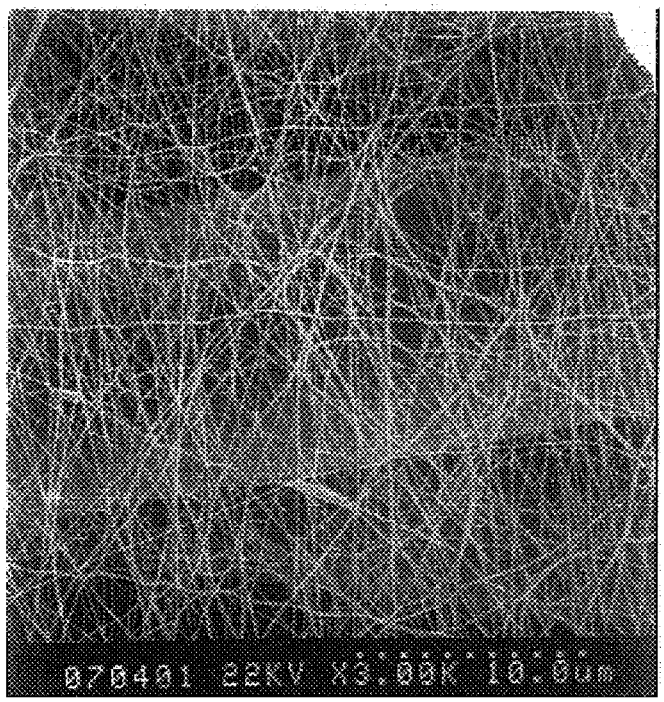
FIG. 16 is SEM of polyester fabric (product of Example 6) coated with nylon 6 nano fibers.

Nylon 6 chip having a relative viscosity of 2.3 was dissolved in formic acid by 25% in 96% of sulfuric acid solution, to prepare a spinning dope. The spinning dope was stored in the main tank 1, quantitatively measured by the metering pump 2, and supplied to the spinning dope drop device 3 of FIG. 4, thereby discontinuously changing flowing of the spinning dope. Thereafter, the spinning dope was supplied to the nozzle block 4 having a voltage of 45 kV, and fibers having an average diameter of 108 nm were continuously spun on polyester plane fabrics (width: 1 m) passed through dipping and compression processes in acryl resin adhesive solution and transferred at a speed of 10 m/min through the nozzles. The fibers were bonded (needle-punched) to prepare a coating web having a weight of 1.2 g/m2. Here, each nozzle block included 250 pins, and 20 nozzle blocks were aligned. Model CH 50 of Symco Corporation was used as the voltage generator. The throughput per one pin was 0.0024 g/min, and thus a total output rate was 12.1 g/min. One nozzle block was divided into 10, and one spinning dope-drop device 3 was installed in every 10 pins. A drop speed had 3-second intervals. The pins were formed in a circular shape. SEM of the prepared coating polyester plane fabric was shown in FIG. 16.

EXAMPLE 7

Figure 17:
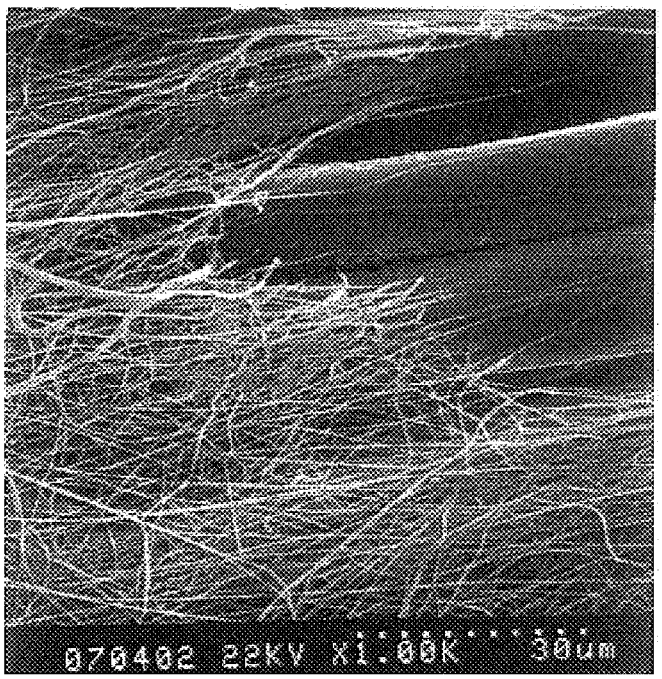
FIG. 17 is SEM of nylon 6 fabric (product of Example 7) coated with nylon 6 nano fibers.

Nylon 6 chip having a relative viscosity of 2.3 was dissolved in formic acid by 25% in 96% of sulfuric acid solution, to prepare a spinning dope. The spinning dope was stored in the main tank 1, quantitatively measured by the metering pump 2, and supplied to the spinning dope drop device 3 of FIG. 4, thereby discontinuously changing flowing of the spinning dope. Thereafter, the spinning dope was supplied to the nozzle block 4 having a voltage of 45 kV, and fibers having an average diameter of 108 nm were continuously spun on nylon 6 plane fabric (width: 1 m) passed through dipping and compression processes in acryl resin adhesive solution and transferred at a speed of 10 m/min through the nozzles. The fibers were bonded (needle-punched) to prepare a coating web having a weight of 1.2 g/m2. Here, each nozzle block included 250 pins, and 20 nozzle blocks were aligned. Model CH 50 of Symco Corporation was used as the voltage generator. The output rate per one pin was 0.0024 g/min, and thus a total throughput was 12.1 g/min. One nozzle block was divided into 10, and one spinning dope drop device 3 was installed in every 10 pins. A drop speed had 3-second intervals. The pins were formed in a circular shape. SEM of the nylon 6 plane fabric coated was shown in FIG. 17.

EXAMPLE 8

Figure 18:
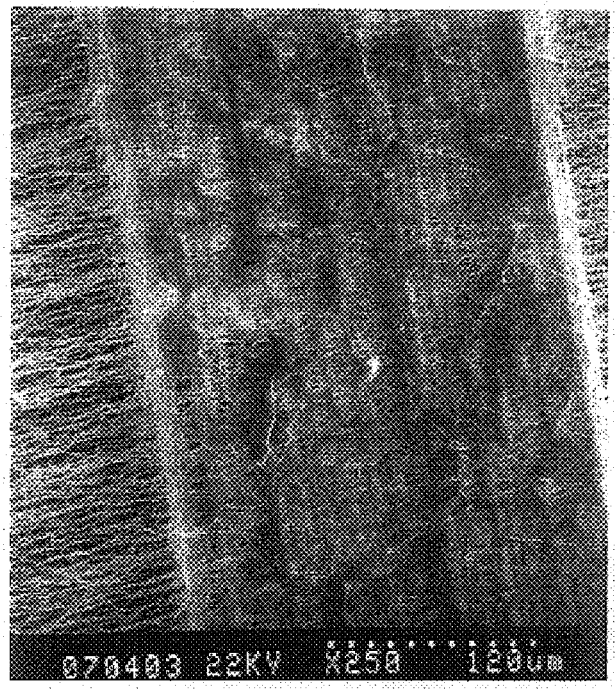
FIG. 18 is SEM of polyester filament (product of Example 8) coated with nylon 6 nano fibers.

Nylon 6 chip having a relative viscosity of 2.3 was dissolved in formic acid by 25% in 96% of sulfuric acid solution, to prepare a spinning dope. The spinning dope was stored in the main tank 1, quantitatively measured by the metering pump 2, and supplied to the spinning dope drop device 3 of FIG. 3, thereby discontinuously changing flowing of the spinning dope. Thereafter, the spinning dope was supplied to the nozzle block 4 having a voltage of 45 kV, and fibers having an average diameter of 1.08 nm were continuously spun and dried on 75 denier 36 filament polyester filament (alignment of 80 strips in 1 inch, width: 1 m) passed through dipping and compression processes in acryl resin adhesive solution and transferred at a speed of 3 m/min through the nozzles. Here, each nozzle block included 250 pins, and 20 nozzle blocks were aligned. Model CH 50 of Symco Corporation was used as the voltage generator. The output rate a one pin was 0.0024 g/min, and thus a total throughput was 12.1 g/min. One nozzle block was divided into 10, and one spinning dope drop device 3 was installed in every 10 pins. A drop speed had 3-second intervals. The pins were formed in a circular shape. A plane fabric(density: 80 threads/inch)was prepared by using the coating polyester filaments as warps and wefts. SEM of the polyester fabric coated was shown in FIG. 18.

EXAMPLE 9

Figure 19:
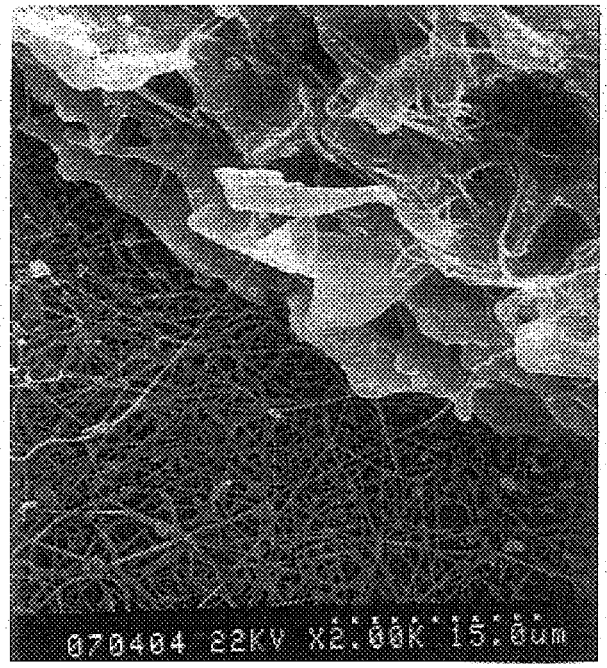
FIG. 19 is SEM of nylon 6 non-woven fabrics coated with polyurethane polymers.

Poly(glycolide-lactide)copolymer (mole ratio:50150)having a viscosity average molecular weight of 450,000 was dissolved in methylene chloride in a normal temperature, to prepare a spinning dope (density:15%). The spinning dope was stored in the main tank 1, quantitatively measured by the metering pump 2, and supplied to the spinning dope drop device 3 of FIG. 4, thereby discontinuously changing flowing of the spinning dope. Thereafter, the spinning dope was supplied to the nozzle block 4 having a voltage of 48 kV, and fibers having an average diameter of 108 nm were continuously spun on poly(L lactide) membrane film (weight: 10 $g/m^2$, width: 60 cm) transferred at a speed of 2 m/min through the nozzles. The fibers were bonded {needle-punched) to prepare a non-woven fabric web having a weight of 2.8 $g/m^2$. Here, each nozzle block included 200 pins, and 10 nozzle blocks were aligned. Model CH 50 of Symco Corporation was used as the voltage generator. The output rate per one pin was 0.0028 g/min, and thus a total throughput was 5.6 g/min. One nozzle block was divided into 10, and one spinning dope drop device 3 was installed in every 50 pins. A drop speed had 3-second intervals. The pins were formed in a circular shape. SEM of the non-woven fabric coated was shown in FIG. 19.

INDUSTRIAL APPLICABILITY

The present invention mass-produces the non-woven fabric composed of the nano fibers, and easily controls th1a thickness and width of the non-woven fabric. In addition, when at least two electrospinning apparatuses are assembled, multi-component polymers can be easily combined, to prepare the hybrid non-woven fabric, Moreover, the non-woven fabric (fiber material)is coated with the nano fibers, and thus has improved softness and performance.

What is claimed is:

1. A method for preparing a non-woven fabric coated with nano fibers comprising the steps of:

spinning the nano fibers on one surface or both surfaces of a transferred fiber material by one or more electrospinning apparatus, including a spinning dope drop device, and bonding the nano fibers, wherein the spinning dope drop device is disposed between a metering pump and a nozzle block and includes: a sealed cylindrical shape, a spinning dope inducing tube and a gas inlet tube for receiving gas through its lower end and having its gas inlet part connected to a filter which is aligned, side-by-side, at the upper portion of the spinning dope drop device, a spinning dope discharge tube protruding from the lower portion of the spinning dope drop device and a hollow unit for dropping the spinning dope from the spinning dope inducing tube formed at the middle portion of the spinning dope drop device.

2. The method according to claim 1, wherein the fiber material is a spun yarn, a filament, a textile, knitted fabrics, a non-woven fabric, paper, a film or a braid.

3. The method according to claim 1, wherein the fiber material is dipped and compressed in an adhesive solution before spinning the nano fibers, and then dried prior to bonding after spinning the nano fibers.

4. The method according to claim 1, wherein the bonding treatment is needle punching, thermal compression, electromagnetic wave treatment, high pressure water injection, supersonic wave treatment or plasma treatment.

5. The method according to claim 1, wherein spinning dopes supplied to the respective electronic spinning apparatus have different polymers when using at least two electrospinning apparatus.

6. The method according to claim 1, wherein the nozzles of the electrospinning apparatus are aligned in block units having at least two pins.

7. The method according to claim 1, wherein the number of pins of one nozzle block ranges from 2 to 100,000.

8. The method according to claim 1, wherein the nozzle pins are of a circular, injection needle type or have different shape sections.

9. The method according to claim 1, wherein the nozzle pins are aligned circumferentially as a grid or in a line.

10. The method according to claim 1, wherein air or an inert gas is introduced into the spinning dope drop device.

11. The method according to claim 1, wherein the spinning dope is a melt or solution.

* * * * *